US007185620B2

(12) United States Patent
Hofmann

(10) Patent No.: US 7,185,620 B2
(45) Date of Patent: Mar. 6, 2007

(54) CAM FOLLOWER OF A VALVE DRIVE OF AN INTERNAL COMBUSTION ENGINE

(75) Inventor: Georg Hofmann, Hassfurt (DE)

(73) Assignee: Ina-Schaeffler KG (DE)

( * ) Notice: Subject to any disclaimer, the term of this patent is extended or adjusted under 35 U.S.C. 154(b) by 0 days.

(21) Appl. No.: 11/113,859

(22) Filed: Apr. 25, 2005

(65) Prior Publication Data

US 2005/0217415 A1 Oct. 6, 2005

Related U.S. Application Data

(63) Continuation of application No. PCT/EP03/11469, filed on Oct. 16, 2003.

(30) Foreign Application Priority Data

Oct. 25, 2002 (DE) ..... 102 49 761

(51) Int. Cl.
*F01L 1/14* (2006.01)

(52) U.S. Cl. ..... 123/90.48; 123/90.51; 123/90.44; 74/569

(58) Field of Classification Search ..... 123/90.16, 123/90.2, 90.39, 90.44, 90.48, 90.51, 90.6, 123/90.33, 90.34, 90.35; 74/559, 567, 569
See application file for complete search history.

(56) References Cited

U.S. PATENT DOCUMENTS

| | | | | |
|---|---|---|---|---|
| 4,783,150 | A * | 11/1988 | Tabony | 349/20 |
| 4,856,466 | A | 8/1989 | Ting et al. | 123/90.33 |
| 4,876,996 | A | 10/1989 | Mayer et al. | 123/90.51 |
| 4,983,468 | A * | 1/1991 | Oda | 428/621 |
| 5,342,698 | A | 8/1994 | Fujisawa et al. | 428/612 |
| 5,597,657 | A | 1/1997 | Gunji et al. | 428/680 |
| 2002/0060159 | A1 | 5/2002 | Shimizu | 205/179 |

FOREIGN PATENT DOCUMENTS

| | | |
|---|---|---|
| DE | 1 841 193 | 7/1960 |
| DE | 27 37 685 A1 | 3/1978 |
| DE | 3241002 A1 | 5/1984 |
| DE | 8516549.2 | 11/1985 |
| DE | 3330141 C2 | 4/1986 |
| DE | 3602477 A1 | 7/1986 |
| DE | 4418245 | 2/1995 |
| DE | 101 47 659 A1 | 7/2002 |

OTHER PUBLICATIONS

German Search Report. 3 pages.
European Search Report. 4 pages.

* cited by examiner

*Primary Examiner*—Ching Chang
(74) *Attorney, Agent, or Firm*—Ostrolenk, Faber, Gerb & Soffen, LLP

(57) ABSTRACT

A cam follower of a valve drive of an internal combustion engine, having a run-on surface for following at least one cam. The run-on surface has a microstructure comprising depressions for accumulating lubricant, wherein the depressions form an at least largely symmetrical microstructure similar to a grid. Two depressions of each enclosed section of the run-on surface running toward each other in the manner of an arrow to form a corner such that they point at least in the predominant direction of a movement of a contact point of a cam on the run-on surface.

10 Claims, 2 Drawing Sheets

CAM FOLLOWER OF A VALVE DRIVE OF AN INTERNAL COMBUSTION ENGINE

CROSS REFERENCE TO RELATED APPLICATION

The present application is a continuation of PCT/EP2003/011469 filed 16 Oct. 2003, which claims priority of German Application No. 102 49 761.3 filed 25 Oct. 2002. The PCT International Application was published in the German language.

FIELD OF THE INVENTION

The invention relates to a cam follower of a valve drive of an internal combustion engine, having a run-on surface for at least one cam, which run-on surface has a microstructure having depressions for the accumulation of lubricant.

BACKGROUND OF THE INVENTION

A cam follower of this type is disclosed in DE 44 18 245 A1, viewed as generic. Tiny recesses or depressions introduced randomly into a run-on surface of the cam follower are proposed. Lubricant is stored in the recesses during the operation of the cam follower. The intention is to minimize friction in the valve drive.

However, in practice, these randomly introduced depressions do not result in any satisfactory minimization of friction, since sufficient lubricant is not accumulated in them. In addition, it is determined that the dynamic load-bearing proportion may also be too low, since, stated simply, the lubricant remains in the recesses.

Cam followers having run-on surfaces which, for example, have a channel-like grinding pattern, are known to the specialist world. During cam contact, some of the lubricant in front of the cam is forced away into the open in an undesired manner from the outwardly open channels. Here, too, it is clear that the formation of a loadbearing lubricant film is made more difficult.

In addition, it was hitherto the intention to create extremely "smoothly" finally machined run-on surfaces. Contrary to the assumptions, however, the wear is relatively high on such "smooth" surfaces, since the lubricant, so to speak, is "wiped away".

OBJECT OF THE INVENTION

The object of the invention is now therefore to provide a cam follower of the type previously described in which the aforementioned disadvantages are eliminated with simple means.

SUMMARY OF THE INVENTION

According to the invention, this object is achieved in that the depressions form an at least largely symmetrical microstructure similar to a grid, in which two depressions, channels or grooves of each enclosed section of the run-on surface run toward each other in the manner of an arrow to form a corner such that they point at least in the predominant direction of a movement of a contact point of the cam on the run-on surface.

On account of the grid-like microstructure proposed by the invention, at least in the region of the immediate run-on of the cam, it is excellently possible to build up lubricant in order to form a dynamically loadbearing lubricant film. As a result of the specifically arrow-like alignment of two depressions for each enclosed section as the cam runs on, the cam pushes the lubricant in the depressions in front of it, so to speak, and the lubricant in different depressions then meet one another at the corner and the lubricant is forced in the direction of the cam running in the opposite direction.

The microstructure should be formed symmetrically on the run-on surface. However, a shape differing slightly from this can also be used. The same applies to the formation of the depressions with enclosed section. It is important at this point that a large number or a major proportion of sections have the depressions running in the manner of an arrow in the direction of the movement of the cam contact point.

Expressed in other words, the two depressions (of course, more than two depressions can also meet one another at a corner), can or should advantageously run toward one another such that, approximately in any direction of a movement of the contact point of the cam, a corner of each enclosed section or and least a large number of sections is swept over.

According to a refinement of the invention, the sections enclosed by the depressions can have formations similar to a rhombus or parallelogram. In general, 3-cornered to n-cornered shapes of the enclosed sections are conceivable.

The two arrow-like depressions per enclosed section can enclose an angle of 15°–75°. An angle of about 45° can be particularly advantageous.

If, as further proposed by the invention, corners are also positioned in the immediate edge region of the run-on surface, then the lubricant is prevented or hindered from running off along a wall of the cam follower. The amount of lubricant necessary to form the dynamic loadbearing lubricant film thus remains on the run-on surface.

Furthermore, it is proposed to provide the contact surfaces with additional wear prevention layers. These make the contact surfaces sufficiently hard. Here, by means of trials familiar to them, those skilled in the art will coordinate the loadbearing component, the roughness and the general formation of a microstructure in such a way that the result is an optimum loadbearing behavior in the contact region. It is also clear in this connection that the microstructure according to the invention is applied at least in the region which experiences cam contact over the lifetime of the cam follower.

A further contribution in the direction of increasing the lifetime of the cam follower proposed by the invention is made in that it is provided with initial roughnesses of $R_z$ in the range between 0.1 and 0.5 μm.

According to a further implementation of the invention, it is proposed to apply the depressions and thus the microstructure by means of a fabrication process such as grinding. Here, consideration is given for example to grinding disks rotating in opposite directions. However, a large number of processes for applying the microstructure, such as embossing, rolling, etching, erosion and the like, are conceivable and provided. In no way is grinding the sole possible fabrication process here.

The invention is intended to be used in a large number of cam followers. For example, thought is given to bucket or mushroom-head tappets or to lever-like cam followers of an extremely wide range of configurations.

BRIEF DESCRIPTION OF THE DRAWINGS

The invention is explained in more detail by using the drawing, in which.

DETAILED DESCRIPTION OF THE DRAWINGS

Figure 1A:
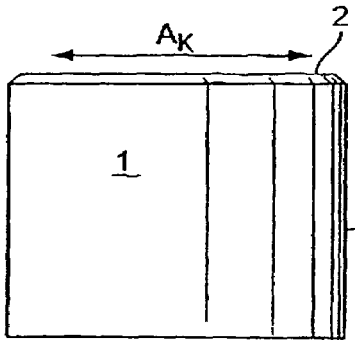
FIGS. 1*a* and 1*b* are side and top views of one embodiment of bucket-like cam followers with a microstructure applied according to the invention.
Figure 2A:
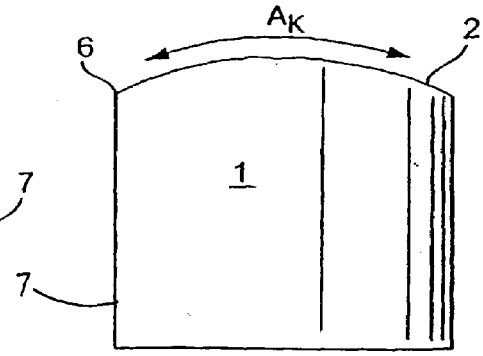
FIGS. 2*a* and 2*b* are side and top views of a second embodiment.
Figure 3A:
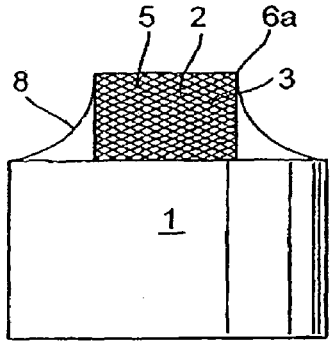
FIGS. 3*a* and 3*b* are side and top views of a third embodiment.
Figure 3B:
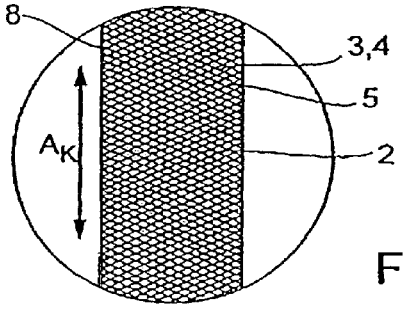

All of the figures of all embodiments disclose a respective cam follower embodiment 1, which is formed as a bucket tappet here. In this case, FIG. 1*a* shows a bucket tappet having a substantially flat course of its run-on surface 2, FIG. 2*a* shows a bucket tappet as aforementioned but with a run-on surface 2 configured cylindrically in the cam direction of movement, and FIGS. 3*a* and 3*b* show a similar bucket tappet to that before but with, a dome-like elevation on the run-on surface 2 seen in FIG. 3*a*. That surface 2 meets a wall 8 of the elevation.

Figure 1B:
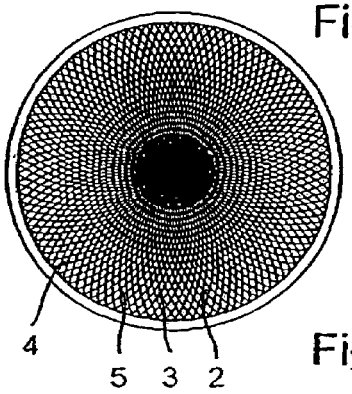
Figure 2B:
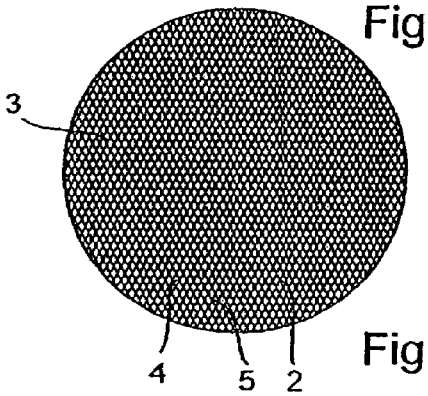
Figure 4:
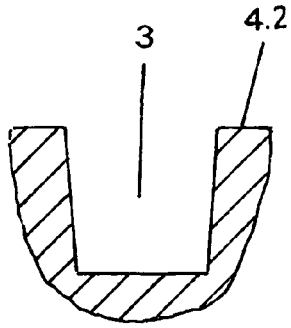
FIG. 4 is an enlarge cross section of a depression in the surface in a microstructure.
Figure 5:
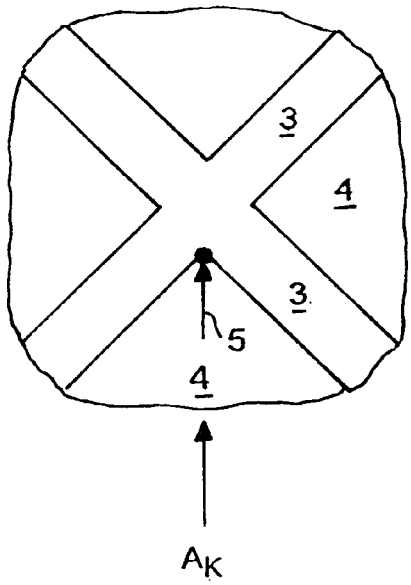
FIG. 5 is an enlarged plan view of an area of intersection of depressions.

FIG. 1*b* shows a plan view of the bucket tappet according to FIG. 1*a*. Its run-on surface 2 has depressions, recesses or grooves 3 (See FIGS. 4 and 5) configured in accordance with the invention for the accumulation of lubricant. As disclosed in FIGS. 1*b*, 2*b* and 3*a* and *b*, a symmetric, grid-like microstructure is produced in the region of the run-on surface 2. Each of sections 4 which are all enclosed by the depressions 3 has a substantially rhombus configuration or a parallelogram, as one embodiment.

Each section 4 is comprised of the original surface of the cam follower before the grinding of depressions or recesses or a similar operation. The recesses. depressions or grooves are formed crosswise into the surface of the cam follower, for example, by grinding. The cam running on the surface of the cam follower 1 has a certain drift direction (see arrow direction in FIG. 5) if the cam follower 1 is protected against torsion. Two recesses 3, which accordingly are located "at the top", meet at a contact point. The cam takes the lubricant with it into the recesses 3 of the cam follower. At the contact point, i.e., where grooves intersect, the lubricant is forced out of the recesses to form a lubricating film. In the case of ideally smooth surfaces, the lubricant would not be held, and wear would occur. Corners of the intersection recesses should run at the edae of the cam follower to prevent the lubricant from running off over the edge.

If a movement of a contact point $A_K$ of the cam on the run-on surface 2 is considered, it can be established that two depressions 3 of each enclosed section 4 run toward each other in the manner of an arrow to form a corner 5. It is clear that what are concerned here are only or at least a large number or a majority of enclosed sections 4 whose depressions point in the manner of arrows in the direction of a movement of the contact point $A_K$.

During the operation of the valve drive, lubricant is stored in the depressions 3 introduced in the manner of a grid. As the cam runs on, it pushes the lubricant in front of it in the depressions 3 tapering in the manner of arrows. In the corresponding corners 5, a collision between the quantities of lubricant then occurs, as a result of which said lubricant is pushed out of the depressions in the direction of the cam contact. Thus, very good formation of a loadbearing lubricant film is promoted or ensured.

As seen in FIGS. 1*b*, 2*a* and 3*a* corners 5 are also formed precisely in the edge region 6, 6*a*, which prevents or hinders the lubricant flowing away along a wall 7 of the cam follower 1.

The grid-like microstructure according to the invention can be produced, for example, by a fabrication process such as grinding.

The invention claimed is:

1. A cam follower comprising a run-on surface for receiving a cam, the run-on surface comprising depressions in the surface for accumulation of lubricant, the depressions are shaped and positioned to form an at least largely symmetrical microstructure similar to a grid, each two of the depressions defining an enclosed section of the run-on surface and the depressions running toward each other in the manner of an arrow to form a corner shape such that the depressions point at least in the predominant direction of a movement of a contact point of the cam on the run-on surface, wherein each of the sections enclosed by respective ones of the depressions has a formation similar to a rhomboid.

2. The cam follower as claimed in claim 1, wherein the cam follower has a sidewall, an immediate edge region of the run-on surface is formed in relation to the wall of the cam follower such that a predominant number of the depressions run out at the respective corners of the depressions at the immediate edge region.

3. The cam follower as claimed in claim 1, wherein each of the two depressions defining each enclosed section run toward each other in the manner of an arrow in the direction of movement of the contact point of the cam to enclose an angle of about between 15°–75°.

4. The cam follower as claimed in claim 1, wherein at least one of the contact surfaces is an outer shell of a cam/run-on surface of the cam follower and is provided with a layer of titanium nitride, PVD, DLC, or a nitride.

5. The cam follower as claimed in claim 1, wherein an initial roughness of about $0.1<RZ<0.5$ μm is inherent in the mn-on surface of the cam follower.

6. The cam follower as claimed in claim 1, wherein the depressions are produced by a fabrication process.

7. The cam follower as claimed in claim 1, wherein the cam follower is formed as a bucket or mushroom head tappet, a lever-like element, a drag lever, an oscillating lever or a tilting lever.

8. The cam follower as claimed in claim 1, wherein the depressions are produced by a fabrication process of grinding.

9. The cam follower as claimed in claim 1, wherein the microcelluar structure is in a grid.

10. The cam follower as claimed in claim 1, wherein the cam follower is shaped and sized as a cam follower for a valve drive of an internal combustion engine.

* * * * *